US005950467A

United States Patent [19]

Dong

[11] Patent Number: 5,950,467

[45] Date of Patent: Sep. 14, 1999

[54] DOOR LOCK

[76] Inventor: Ming-Po Dong, No. 38, Ming Shen Rd., Yuanlin Chen, Changhwa Hsien, Taiwan

[21] Appl. No.: 09/217,068

[22] Filed: Dec. 21, 1998

[51] Int. Cl.[6] ..... E05B 55/00

[52] U.S. Cl. ..... 70/467; 70/370; 70/451; 70/468; 70/483; 292/150; 292/359

[58] Field of Search ..... 70/370, 451, 416, 70/152, 467, 468, 471, 473, 481–483, 487; 292/150, 359

[56] References Cited

U.S. PATENT DOCUMENTS

| | | | |
|---|---|---|---|
| Re. 15,569 | 4/1923 | Ottinger | 292/150 X |
| 649,706 | 5/1900 | Phelps | 70/152 X |
| 1,572,077 | 2/1926 | Perez | 70/416 |
| 1,840,416 | 1/1932 | Scrivener | 292/150 X |
| 1,956,388 | 4/1934 | Kalina | 70/416 |
| 2,435,634 | 2/1948 | Nicolin et al. | 292/150 X |
| 2,525,340 | 10/1950 | Clark | 292/359 |
| 2,580,196 | 12/1951 | Schlage | 292/150 X |
| 2,839,913 | 6/1958 | Friedman et al. | 292/359 |
| 3,591,218 | 7/1971 | Gowland | 292/150 X |
| 3,919,867 | 11/1975 | Lipschutz et al. | 70/416 X |
| 4,216,985 | 8/1980 | Sorensen | 292/359 X |

*Primary Examiner*—Lloyd A. Gall
*Attorney, Agent, or Firm*—Dougherty & Troxell

[57] ABSTRACT

A door lock includes an external locking unit and an internal locking unit mounted on the door body of a door at outer and inner sides to hold a lock cylinder, and a locking bolt unit controlled by the external locking unit to lock/unlock the door, the internal locking unit having a circular base block fixedly fastened to the door body, a rotary cover rotatably mounted on the circular base block, a shaft forced by a spring member into engagement with the spindle of the lock cylinder, and a sliding knob mounted on the rotary cover and shifted between a first position wherein the rotary cover and the spindle of the lock cylinder are stopped from rotary motion, and a second position where the rotary cover and the spindle of the lock cylinder are allowed to be rotated between the locking position and the unlocking position.

10 Claims, 5 Drawing Sheets

DOOR LOCK

BACKGROUND AND SUMMARY OF THE INVENTION

The present invention relates to a door lock, and more particularly to such a door lock which is strong, safe, and practical in use.

A variety of door locks have been disclosed for use to lock a door. FIG. 1 illustrates a door lock for this purpose. This structure of door lock comprises an external lock body and an internal lock body respectively mounted on the door body of the door at two opposite sides, two coupling rods mounted inside the door body and connected between the lock cylinder of the external lock body and the internal lock body, and a locking bolt controlled to lock/unlock the door. The internal lock body has a rotary handle that can be rotated to lock/unlock the locking bolt. This structure of door lock has numberous drawbacks as outlined hereinafter. One drawback of this structure of door lock is its complicated installation procedure. Another drawback of this structure of door lock is that the external lock body tends to be broken and disconnected from the coupling rods by violence. Still another drawback of this structure of door lock is that the internal lock body can not stop the spindle from rotation, and the spindle of the lock cylinder can easily be rotated with tool means to unlock the locking bolt. Furthermore, because the rotary handle of the internal lock body does not keep the internal lock body mounting screws from sight, the internal lock body mounting screws are exposed to the outside, causing the sense of beauty of the door to be destroyed.

The present invention has been accomplished to provide a door lock which eliminates the aforesaid drawbacks. According to an internal locking unit holding a lock cylinder, an internal locking unit, and a locking bolt unit controlled by the lock cylinder to lock/unlock the door, wherein said internal locking unit is controlled by a sliding knob to lock/unlock the spindle of the lock cylinder. According to another aspect of the present invention, two C-shaped reinforcing plates are respectively mounted on outer face panel and inner face panel of the door body of the door at an inner side, and respectively connected to the casing of the external locking unit and the circular base block of the internal locking unit by mounting screws to reinforce the strength of the door lock. According to still another aspect of the present invention, the internal locking unit has a rotary cover covered on the circular base block to keep the respective mounting screws from sight.

DETAILED DESCRIPTION OF THE PREFERRED EMBODIMENT

Figure 1:
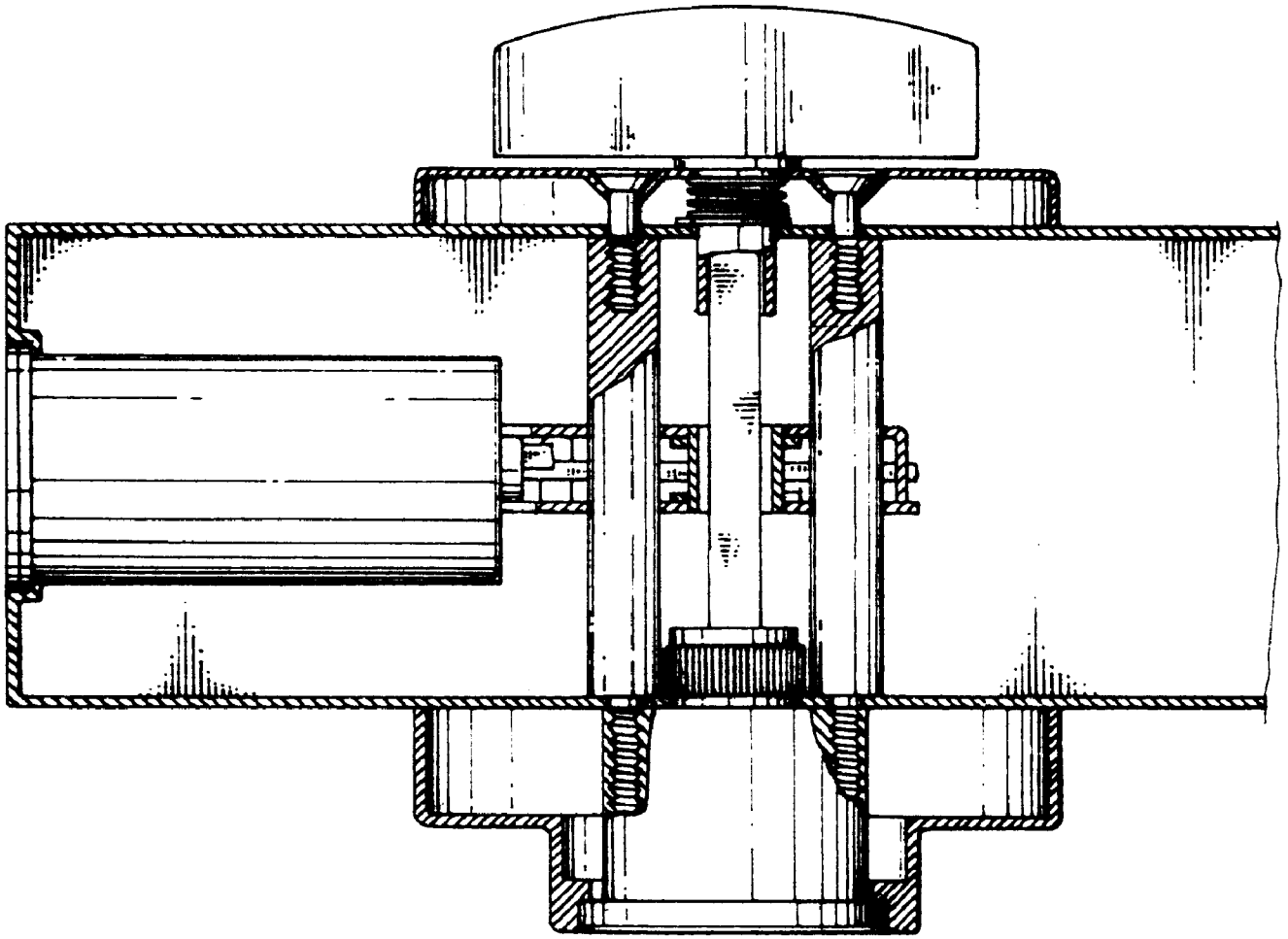
Fig. 1 PRIOR ART
FIG. 1 is a sectional view of a door lock according to the prior art.
Figure 2:
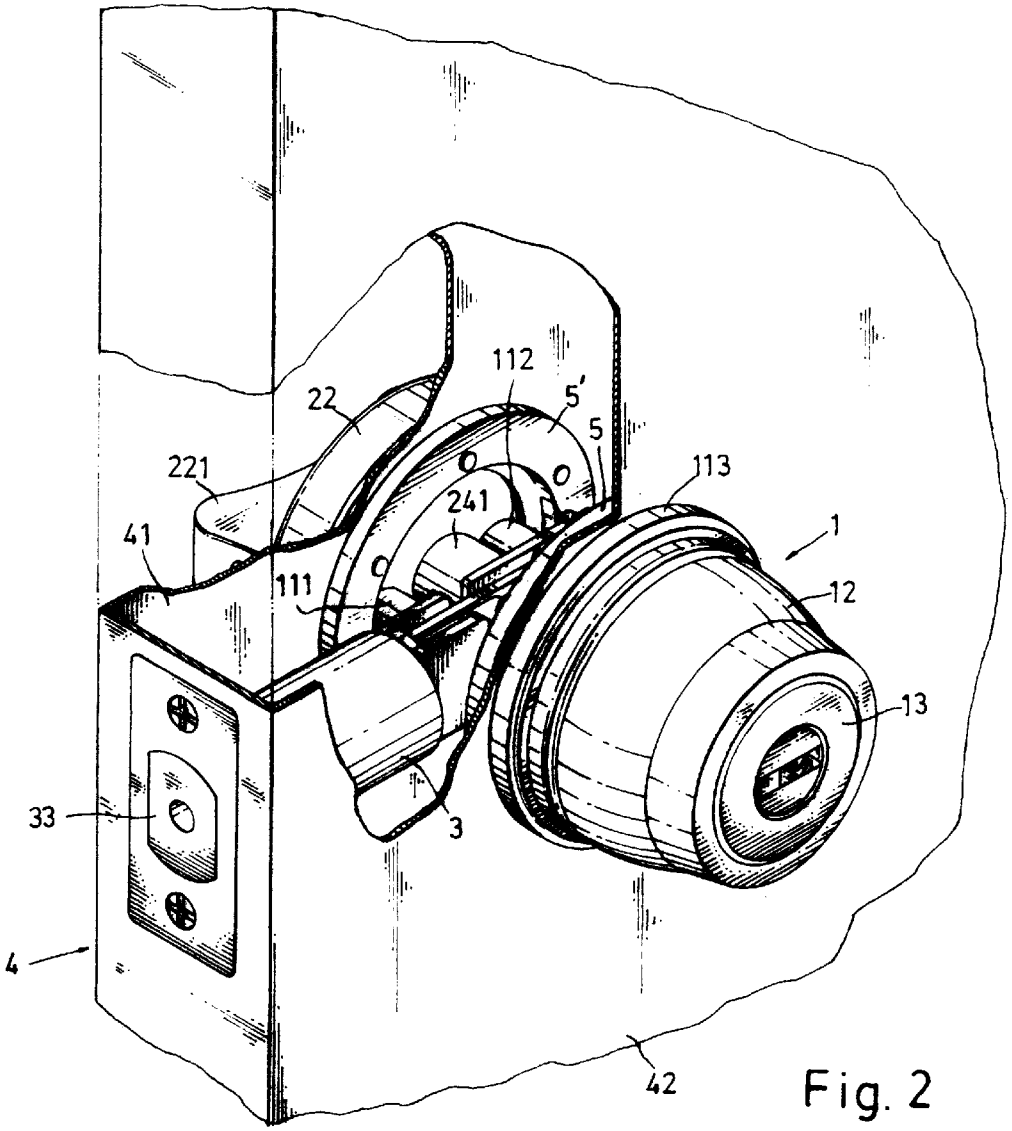
FIG. 2 is a perspective view of the present invention, showing the door lock installed in the door body of a door.
Figure 3:
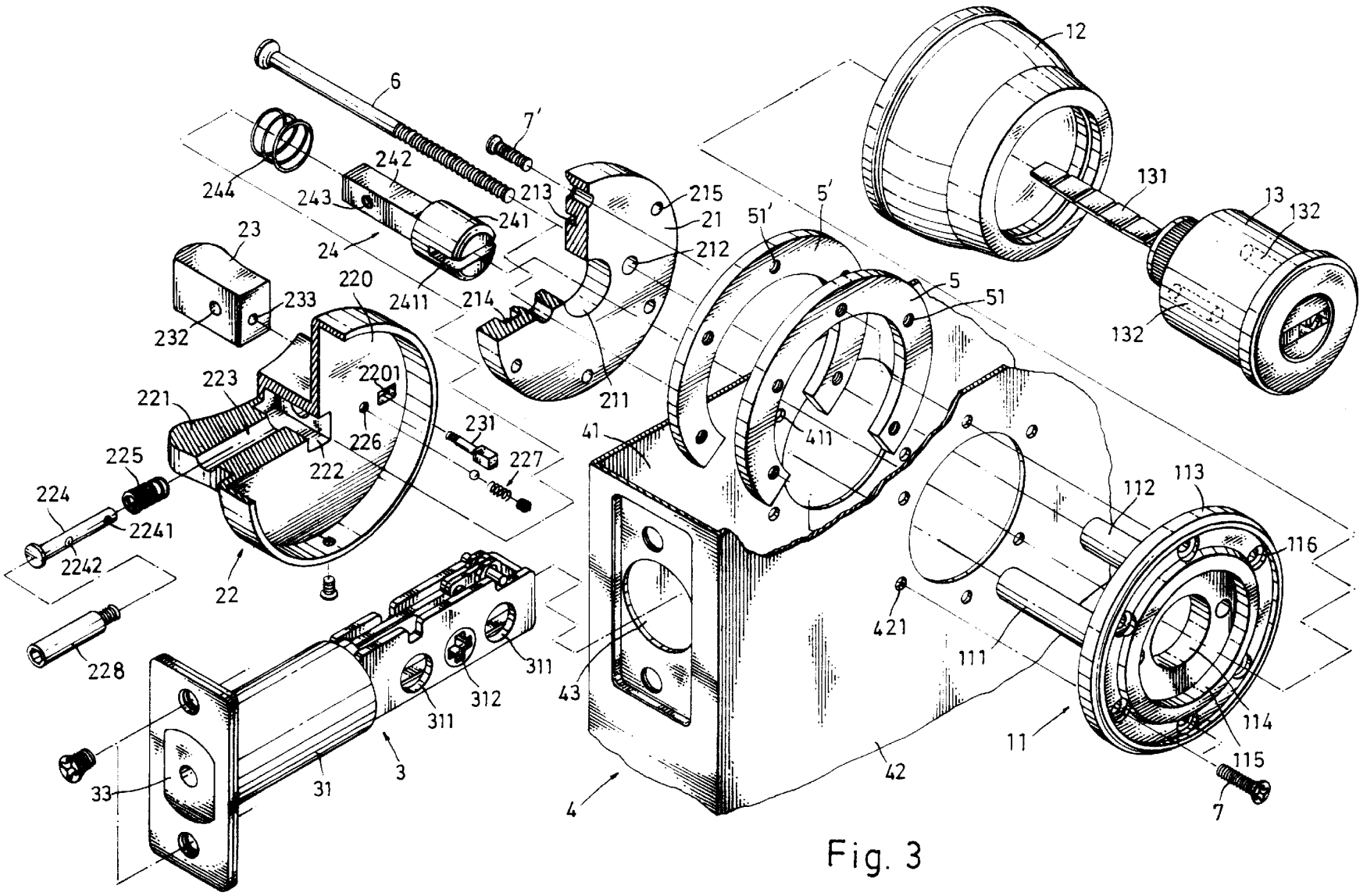
FIG. 3 is an exploded view of the door lock according to the present invention.

Referring to FIGS. from 2 through 4, a door lock in accordance with the present invention is generally comprised of an external locking unit 1, an internal locking unit 2, and a locking bolt unit 3.

The external locking unit 1 is fastened to the door body 4 at an outer side, comprising a casing 11, an outside knob 12, and a lock cylinder 13. The casing 11 of the external locking unit 1 comprises a circular base shell 113, a circular recess 115 at the center of the circular base shell 113 at one side for holding the lock cylinder 13, a circular center hole 114 through the center of the circular recess 115, two parallel nuts 111 and 112 perpendicularly raised from the circular base shell 113 at one side opposite to the circular recess 115 and arranged at two opposite sides of the circular center hole 114, and a plurality of mounting holes 116 provided at the circular base shell 113 and equiangularly spaced around the circular recess 115. Screws 7 are respectively mounted in the mounting holes 116 at the casing 11 and respective mounting holes 421 at an outer face panel 42 of the door body 4, and threaded into respective screw holes 51 at a C-shaped reinforcing plate 5 to secure the casing 11 and the C-shaped reinforcing plate 5 to the outer face panel 42 at two opposite sides, permitting the nuts 111 and 112 to be respectively extended into the inside of the door body 4. The outer knob 12 is coupled to the circular base shell 113 of the casing 11 to hold the lock cylinder 13 in the circular recess 115. The lock cylinder 13 comprises two axially extended screw holes 132 respectively connected to the nuts 111 and 112 of the casing 11 by two screw bolts 6.

The internal locking unit 2 is fastened to the door body 4 at an inner side opposite to the external locking unit 1, comprising a circular base block 21, a rotary cover shell 22, a sliding knob 23, and a shaft 24. The shaft 24 comprises a square shaft body 242, and a cylindrical head 241 at one end of the square shaft body 242. The circular base block 21 comprises a circular center hole 211, which receives the cylindrical head 241 of the shaft 24, two insertion holes 212 at two opposite sides of the circular center hole 211 through which the screw bolts 6 are inserted and threaded into the nuts 111 and 112 of the casing 11 and the screw holes 132 at the lock cylinder 13, a plurality of mounting holes 215 equiangularly spaced around the border area thereof, an annular groove 213 at one side thereof around the circular center hole 211, and a notch 214 in communication with the annular groove 213 for receiving headed lock pin 231 of the sliding knob 23 of the internal locking unit 2. Screws 7' are respectively mounted in the mounting holes 215 at the circular base block 21 and respective mounting holes 411 at an inner face panel 41 of the door body 4, and threaded into respective screw holes 51' at a C-shaped reinforcing plate 5' to secure the circular base block 21 and the C-shaped reinforcing plate 5' to the inner face panel 41 at two opposite sides. After installation of the circular base block 21, the screw bolts 6 are respectively inserted through the insertion holes 212 at the circular base block 21 of the internal locking unit 2, and threaded into the nuts 111 and 112 of the casing 11 and screw holes 132 at the lock cylinder 13 to fix the lock cylinder 13 to the circular base shell 113 of the casing 11. The rotary cover shell 22 is covered on the circular base block 21, comprising a handle 221, a square center hole 222, which receives one end of the square shaft body 242 of the shaft 24, a through hole 223 axially extended through the handle 221 and intersected with the square center hole 222, the through hole 223 having a front neck 2231, a locking hole 226 provided at the inside wall 220 thereof and perpendicularly extended from the front neck 2231 of the through hole 223, a headed sliding rod 224 mounted in the through hole 223 and inserted into a transverse blind hole 232 at the bottom with its head stopped at the square shaft body 242 of the shaft 24, and a compression spring 225 mounted around the headed sliding rod 224 and stopped at one end of the front neck 2231 and the head of the headed sliding rod 224. The headed sliding rod 224 has a screw hole 2241 disposed inside the transverse blind hole 232 at the sliding knob 23 for the connection of the headed lock pin 231, which has a threaded pin body inserted through an oblong through hole 2201 at the rotary cover shell 22 into an axial blind hole 233 at the sliding knob 23 and threaded into the screw hole 2241 of the headed sliding rod 224, and a locating groove 2242 around the periphery. A locating device 227 which is comprised of a steel ball, a compression spring and a screw rod is mounted in the locating hole 226, and engaged into the locating groove 2242 to hold down the headed sliding rod 224. A screw member 228 is mounted in the through hole 223, and threaded into a transverse screw hole 243 at the square shaft body 242 of the shaft 24. The cylindrical head 241 of the shaft 24 has an axially extended coupling groove 2411 engaged with the spindle 131 of the lock cylinder 13. A compression spring 244 is mounted around the square shaft body 242 of the shaft 24, and stopped between the inside wall 220 of the rotary cover shell 22 and the cylindrical head 241 of the shaft 24.

The locking bolt unit 3 is mounted in a hole 43 at one side panel of the door body 4, comprised of a casing 31 having transverse through holes 311 and 312 through which the nuts 111 and 112 of the casing 11 and the spindle 131 of the lock cylinder 13 are inserted, and a locking bolt 33 moved in and out of the casing 31.

Figure 4:
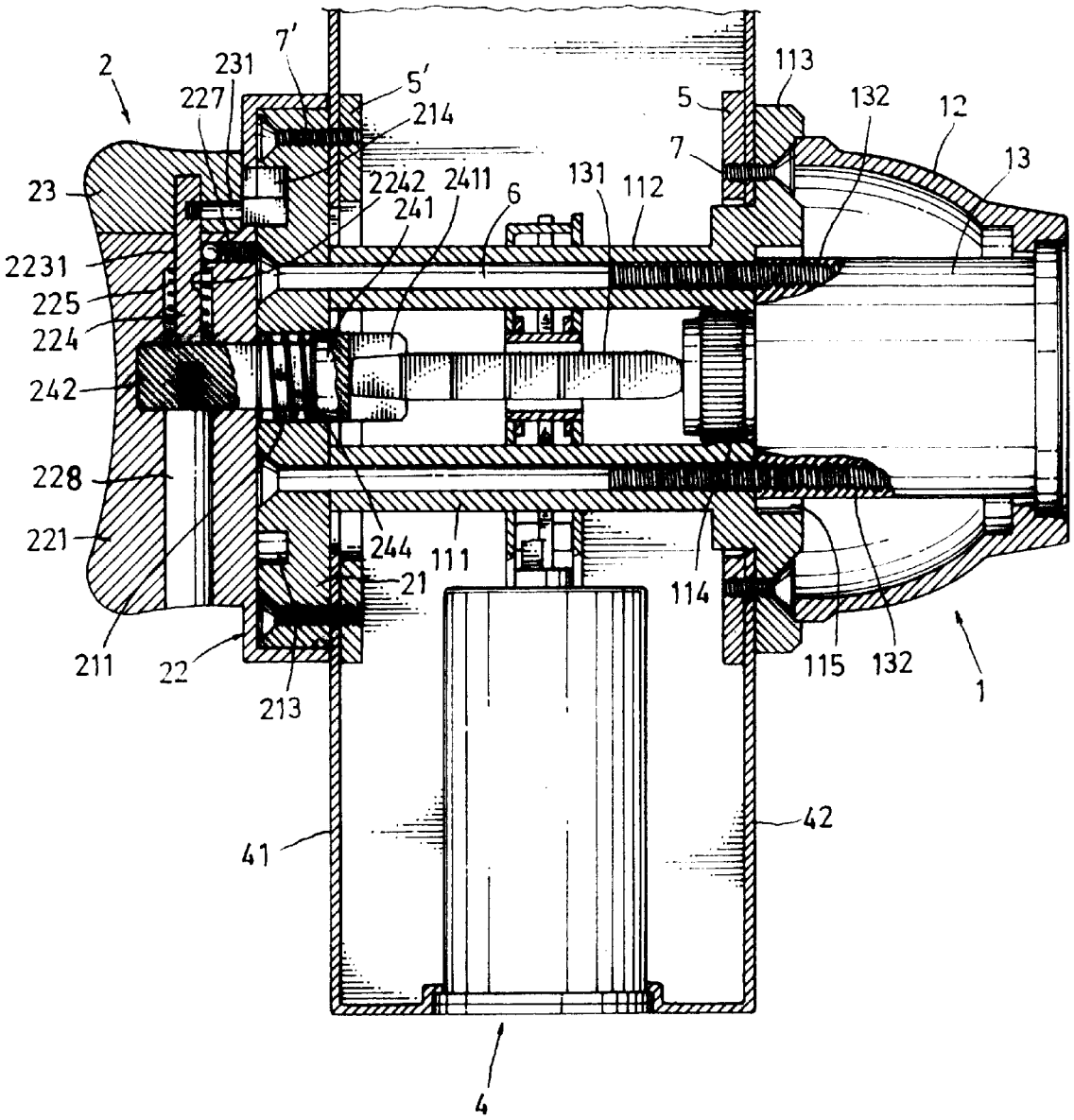
FIG. 4 is a sectional assembly view of the present invention.
Figure 5:
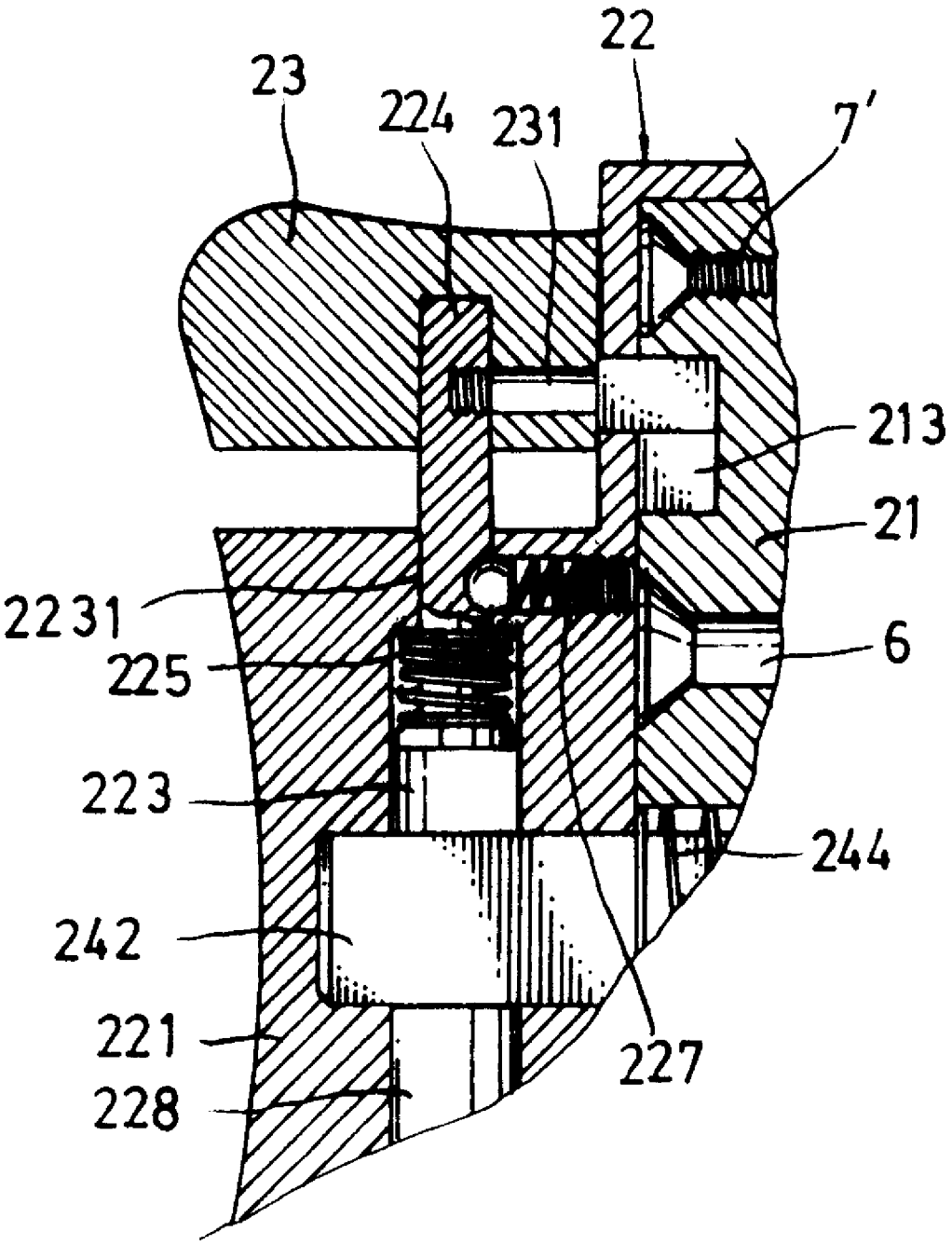
FIG. 5 is an enlarged view of a part of FIG. 4.

Referring to FIG. 5 and FIG. 4 again, the sliding knob 23 is coupled to the handle 221 of the rotary cover shell 22 by the headed sliding rod 224, and the head of the headed lock pin 231 is perpendicularly inserted into the annular groove 213 at the circular base block 21 to guide rotary motion of the rotary cover shell 22 on the circular base block 21. When the sliding knob 23 is moved in one direction to force the headed lock pin 231 into the notch 214 in the annular groove 213 of the circular base block 21, the rotary cover shell 22 is prohibited from rotary motion, that is, the locking bolt 33 of the locking bolt unit 3 is still locked in the casing 31. When the sliding knob 23 is moved in the reversed direction to shift the headed lock pin 231 out of the notch 214, the rotary cover shell 22 is allowed to be rotated with the spindle 131, enabling the locking bolt 33 to be moved in and out of the hole 43 at one side panel of the door body 4 between the locking position and the unlocking position.

I claim:

1. A door lock installed in the door body of a door and operated to lock/unlock the door, said door lock comprising an external locking unit mounted on an outer face panel of the door body of the door, an internal locking unit mounted on an inner face panel of the door body of the door, and a locking bolt unit driven by said external locking unit to lock/unlock the door body of the door, said external locking unit comprised of a casing, an outside knob, and a lock cylinder, said internal locking unit comprised of a circular base block, a rotary cover mounted on said circular base block, a sliding knob, and a shaft, wherein:

the casing of said external locking unit comprises a circular base shell fixedly fastened to the outer face panel of the door body, a circular recess at the center of said circular base shell at one side, which holds said lock cylinder, a circular center hole through the center of said circular recess, two parallel nuts perpendicularly raised from said circular base shell and inserted into the inside of the door body;

the outside knob of said external locking unit is mounted on the circular base shell of the casing of said external locking unit to hold said lock cylinder in the circular recess of said circular base shell;

the lock cylinder of said external locking unit is fixedly fastened to an inner face panel of the door body of the door, comprising a circular center hole in paid circular base block, which receives said shaft and connected to the nuts of the casing of said external locking unit, an annular groove at one side around the circular center hole thereof, and a notch perpendiculary extended from said annular groove;

said rotary cover of said internal locking unit is mounted on said circular base block, comprising a handle, a center hole, which receives one end of said shaft, a through hole axially extended through said handle and intersected with the center hole thereof, a headed sliding rod axially moved in the through hole in said handle and perpendicularly connected to said sliding knob of said internal locking unit, said headed sliding rod having a locating groove on the periphery thereof, an oblong hole, a threaded locating hole, and a spring-supported locating device mounted in said threaded locating hole and engaged into the locating groove at said headed sliding rod to hold said headed sliding rod in position;

said sliding knob of said internal locking unit is coupled to one end of said headed sliding rod outside said rotary cover, having a lock pin connected to one end thereof, said lock pin being extended through the oblong hole on said rotary cover and perpendicularly inserted into the annular groove at said circular base block of said internal locking unit and moved with said sliding knob between a first position wherein said lock pin is engaged into the notch at said circular base block of said internal locking unit to stop said rotary cover from rotary motion relative to said circular base block of said internal locking unit, and a second position wherein said lock pin is disengaged from the notch at said circular base block of said internal locking unit, allowing said rotary cover to be rotated on said circular base block of said internal blocking unit.

2. The door lock of claim 1 wherein the center hole of said rotary cover is a square hole, which receives a square end of said shaft.

3. The door lock of claim 1 wherein the through hole in the handle of said rotary cover of said internal locking unit has a front neck perpendicularly connected to the center hole of said rotary cover.

4. The door lock of claim 3 wherein said internal locking unit further comprises a compression spring mounted around said headed sliding rod, and stopped between the head of said headed sliding rod and one end of the front neck of the through hole in the handle of said rotary cover.

5. The door lock of claim 1 wherein said sliding knob comprises a transverse blind hole, and an axial hole perpendicularly extended from said transverse blind hole; said headed sliding rod has a front end inserted into the transverse blind hole at said sliding knob, and a screw hole at the periphery of the front end thereof; said lock pin is inserted through the axial hole at said sliding knob and threaded into the screw hole at said headed sliding rod.

6. The door lock of claim 1 wherein said spring-supported locating device is comprised of a screw rod threaded into the threaded locating hole at said rotary cover of said internal locking unit, a steel ball, and a spring element mounted in said threaded locating hole and stopped between the screw rod of said spring-supported locating device and said steel ball to force said steel ball into engagement with the locating groove at said headed sliding rod.

7. The door lock of claim 1 wherein said internal locking unit further comprises a screw member mounted in the through hole in said handle of said rotary cover and threaded into a transverse screw hole at said shaft.

8. The door lock of claim 1 wherein said shaft comprises a square shaft body inserted into the center hole of said rotary cover, a cylindrical head at one end of said square shaft body, said cylindrical head having a split for engagement with the spindle of said lock cylinder, and a compression spring mounted around said square shaft body and stopped between said rotary cover and said cylindrical head of said shaft to force said shaft into engagement with the spindle of said lock cylinder.

9. The door lock of claim 5 wherein said lock pin has a threaded pin body inserted through the axial hole at said sliding knob and threaded into the screw hole at said headed sliding rod, and a head connected to one end of said Pin body and perpendicularly inserted into the annular groove at said circular base block of said internal locking unit.

10. The door lock of claim 1 further comprising two C-shaped reinforcing plates respectively mounted on the outer face panel and inner face panel of the door body of the door and fixedly connected to the circular base shell of the casing of said external locking unit and the circular base block of said internal locking unit.

* * * * *